US005893359A

United States Patent [19]

Schultheis et al.

[11] Patent Number: 5,893,359

[45] Date of Patent: Apr. 13, 1999

[54] ARRANGEMENT FOR ASSEMBLING AND MOUNTING A BUILT-IN COOKTOP

[75] Inventors: Bernd Schultheis, Schwabenheim; Martin Taplan, Rheinböllen; Otmar Stengg, Brenner; Franz Hammer, Mieders, all of Germany

[73] Assignee: Schott Glaswerke, Mainz, Germany

[21] Appl. No.: 08/737,435

[22] PCT Filed: Sep. 14, 1995

[86] PCT No.: PCT/DE95/01257

§ 371 Date: Nov. 12, 1996

§ 102(e) Date: Nov. 12, 1996

[87] PCT Pub. No.: WO96/10153

PCT Pub. Date: Apr. 4, 1996

[30] Foreign Application Priority Data

Sep. 29, 1994 [DE] Germany ..... 44 34 821

[51] Int. Cl.[6] ..... H05B 3/68

[52] U.S. Cl. ..... 126/214 A; 219/464; 219/467

[58] Field of Search ..... 126/211, 214 R, 126/214 A, 39 H; 219/467, 464; 312/140.4, 236, 242; 4/635, 636

[56] References Cited

U.S. PATENT DOCUMENTS

| | | | |
|---|---|---|---|
| 2,778,032 | 1/1957 | Meehan . | |
| 2,890,462 | 6/1959 | Ross | 126/214 |
| 2,992,315 | 7/1961 | McDonnold | 126/214 A |
| 3,680,152 | 8/1972 | Farrell | 4/187 A |
| 4,363,956 | 12/1982 | Scheidler et al. | 219/464 |

FOREIGN PATENT DOCUMENTS

| | | |
|---|---|---|
| 397424 | 4/1994 | Austria . |
| 2819118 | 10/1979 | Germany . |
| 3126013 | 1/1983 | Germany . |
| 9108044 | 9/1992 | Germany . |
| 9301942 | 5/1993 | Germany . |
| 4329956 | 3/1995 | Germany . |

*Primary Examiner*—Carl D. Price
*Attorney, Agent, or Firm*—Walter Ottesen

[57] ABSTRACT

The present invention relates to an arrangement for assembling and mounting a built-in cooktop such as a glass-ceramic cooktop wherein the cooktop is seated latchably secured from above in a countertop cutout provided therefor. Tolerance problems between the built-in cooktop and the countertop cutout are avoided in that, in the assembly into the countertop cutout, an ancillary assembly frame is premounted with a precise fit to the built-in cooktop. The built-in cooktop is seated in the ancillary assembly frame and is secured via clamping connections or latch connections.

7 Claims, 4 Drawing Sheets

ARRANGEMENT FOR ASSEMBLING AND MOUNTING A BUILT-IN COOKTOP

FIELD OF THE INVENTION

The invention relates to an arrangement for assembling and mounting a built-in cooktop, especially a glass-ceramic cooktop, wherein the cooktop can be seated and latched in a cutout of a countertop. The cooktop is seated from above and the cutout is provided therefor.

BACKGROUND OF THE INVENTION

Cooktops are, as a rule, seated in the cutout of the countertop of a row of kitchen base cabinets from above and are fixed from below by means of suitable attachment elements such as so-called clamping brackets. In this connection, the problem can occur that the attachment elements can only be mounted laterally for reasons of space when lower cabinets are present.

Furthermore, additional electric apparatus can be installed below the countertop such as a baking oven or the like. These additional electric apparatus must be taken out when assembling the cooktop in the manner described above. Furthermore, it can happen that the cooktop is wider than one of the two cabinet components beneath the countertop. These cabinet components are separated from each other by a center wall. In all of these cases, it is very difficult in the event of a defect to remove the cooktop because this is only possible when the attachment elements are accessible from below. The circumstances mentioned above makes this very difficult in practically all situations which can occur.

In the meantime, other systems have become known wherein cooktops no longer are attached from below in the countertop cutout but are reliably fixed with latching means from above by means of clamping and latching elements which correspond to each other and are arranged on the cooktop as well as on the countertop cutout. In addition to providing a simple assembly from above, this affords the further advantage that the cooktop can be disconnected from the countertop cutout with relative ease. Accordingly, in DE 91 08 044 U1, which constitutes the preamble of the present claim 1, an arrangement is suggested wherein the entire cooktop is seated during assembly from above in the countertop cutout provided therefor and is secured in this position via snap or latch connections. For this purpose, clamping springs are provided laterally on the cooktop frame and these clamping springs coact with holding means such as round pins. The holding means are directed horizontally inwardly and are attached to the sides of the cutout of the countertop. The clamping springs are themselves held via a clamping connection on the cooktop frame so as to be laterally displaceable in order to provide a tolerance equalization with reference to the holding means.

The cooktop known from DE 93 01 942 U1 differs from the arrangement described above only in that the clamping springs are not mounted on the cooktop frame but on the sides of the cutout of the countertop and the corresponding holding means (here latches) are arranged laterally on the cooktop frame and not in the cutout of the countertop.

These known constructions have the disadvantage that either the assembly tolerances are too tight or, as described above, complex constructive means are provided which are intended to provide a certain tolerance equalization. This is made more difficult in that, with the known cooktops, the assembly of the connecting means in the countertop cutout and the assembly of the corresponding connecting means on the frame of the cooktop is carried out at different locations so that large deviations in the position of the connecting means, which are associated with each other, can be expected relative to each other. In this way, the connecting means are mounted on the frame of the cooktop by the manufacturer thereof; whereas, the connecting means are mounted in the countertop cutout by the kitchen contractor at the work site.

SUMMARY OF THE INVENTION

It is an object of the invention to improve an arrangement of the kind described above for assembling and mounting a cooktop so that the assembly and disassembly are still further simplified.

According to the invention, the cooktop is not assembled directly into the countertop cutout as in the state of the art described above but is assembled by means of an ancillary assembly frame which is preassembled in the countertop cutout before seating the cooktop. Mounting the cooktop as described in the state of the art would bring with it the above-described tolerance problems. The ancillary assembly frame is seated in the countertop cutout and is fixed in the desired location by means of suitable attachment means such as screws. The ancillary assembly frame includes the attachment elements corresponding to the connecting means of the cooktop. These attachment elements are clamping or latching elements as known, for example, from the above-described publications.

The cooktop can then, in a simple manner, be clipped into the ancillary assembly frame fixed in the countertop cutout. The ease of assembly and ease of recycling known from the state of the art is thereby ensured. An improvement relative to the state of the art is achieved in that the ancillary assembly frame including the arrangement of its clamping or latching elements is fitted precisely to the cooktop. The advantage of this cooktop construction is that the cooktop assembly in the kitchen can take place from above without, for example, it being necessary to first remove, for example, a baking oven. Tolerance problems are avoided by the use of the ancillary assembly frame which fits precisely to the corresponding cooktop.

It is furthermore advantageous that an ancillary frame of this kind can be used, at the same time, as a sawing template for the countertop cutout. For this purpose, the ancillary frame is placed upon the countertop and the corresponding positions of the cooktop are aligned. The cutout must then only be drawn with a pencil on the outer edge of the ancillary assembly frame and thereafter cut out by sawing.

The ancillary assembly frame is preferably one piece. Simple manipulability and excellent fitting is achieved. In the simplest case, the ancillary assembly frame is made of several stamped, bent pieces of strip sheet metal which are assembled by pressure welding, pressure joining connections or by rivets to form a one-piece continuous frame. A material such as corrosion-resistant sheet metal, such as galvanized sheet metal or high-grade steel sheet metal, is used. Joined aluminum angles are also conceivable.

Latching elements can be mounted around the whole periphery laterally on the ancillary assembly frame or on legs bent over horizontally. Preferably two to three latch elements per side are provided which can latch into corresponding receptacles on the cooktop. The latch elements can, for example, be laterally mounted outwardly bent spring sheet metal defining latch noses which latch laterally into the cooktop or the latch elements can be conical pins mounted on the horizontally bent-over part. These conical pins then latch into corresponding openings in the base of the cook plate. Such conical pins are already known and belong to the state of the art. It is advantageous here that the latch elements correspond exactly to the corresponding latch receptacles on the cook plate so that there is no tolerance problem caused by the assembly of individual attachment means.

A cooktop in the context of the present invention is to be understood, without limitation, the assembly which has a heating unit mounted therein as well as, as required, a sensor arrangement and an electronic control unit and a cook plate mounted on the cook plate housing latched thereto. The cook plate is preferably of glass ceramic having a corresponding enclosing frame construction. The enclosing frame construction includes many variations. Thus, the enclosing frame can, for example, only comprise a support frame which is attached to the cooktop housing. Also, arrangements comprising a decorative frame and a support frame overlapping the cook plate are conceivable such as, for example, those known from DE 28 19 118. The cooktop can be glued to the corresponding frame construction in different ways or can be sealed with respect thereto.

Preferably, the arrangement of the invention is utilized in combination with a decorative frame construction and a support frame construction wherein the cook plate is clamped between the decorative frame and the support frame with a seal overlay being interposed therebetween. In the simplest case, the support frame is fixed in the cooktop housing whereas the decorative frame, which overlaps the cook plate, is clipped into the cooktop housing from above or into the ancillary assembly frame. In the latter case, the clamp connection or latch connection between the ancillary assembly frame and the decorative frame can, at the same time, define the clamp connection and latch connection between the built-in cooktop and the ancillary assembly frame. The cooktop housing lies on a corresponding support surface on the ancillary assembly frame and is fixed via the decorative frame which is inserted from above into the ancillary assembly frame.

The described variations afford the advantage of dry assembly at the manufacturer. This is understood to mean the deliberate omission of an adhesive in the conventional sense. This affords the advantage that for the assembly the otherwise usual curing time for adhesive (usually 1 to 3 days for silicone) must no longer be considered which makes intermediate storage superfluous.

In addition, in the case of a service call, defective heating elements as well as damaged cooktops can be directly exchanged at the work site. The user is provided with the possibility of exchanging old unwanted decor or decorative frames rapidly and at low cost. With respect to recycling, these configurations can be seen as optimal because, as a consequence of the dry assembly, the cooktop can be separately disassembled in a short time with respect to various materials.

In the embodiments described above, the decorative frame can have lateral flat latch prongs bent over at an angle for establishing the clamp connection to the cooktop housing or to the ancillary assembly frame. The latch prongs are made of sheet metal and latch in corresponding flat spring elements in the cooktop housing or the ancillary assembly frame. In the first variation, the spring forces of the latch elements from the ancillary assembly frame to the cooktop as well as the spring forces between the decorative frame and the cooktop housing can be matched to each other so that, on the one hand, either when building in or removing the cooktop, relatively large spring forces must be overcome or, on the other hand, the forces holding the cooktop together are relatively large compared to the holding forces of the cooktop.

In a preferred embodiment, the spring forces between the decorative frame and the cooktop housing are greater than the spring forces for holding the cooktop in the countertop, that is, in the ancillary assembly frame, so that the kitchen contractor can build in or remove the complete cooktop in the closed condition (for example, with a move or remodeling of the kitchen). In addition, and with respect to the reliability and usability, an adequate sealing between the decorative frame, cooktop plate and cooktop housing is provided because of the greater spring forces between the decorative frame and the housing.

The cook plate can, for example, lie on a permanent-elastic seal overlay. The seal profile facing toward the cook plate in the decorative frame can comprise a foamed temperature-resistant material, preferably made of a silicone foam profile. The other sealing profile is mounted between the cook plate and the decorative frame and lower temperature requirements apply to this other seal profile. Here, for example, polyurethane foam or foamed EPDM (an ethylene propylene diene rubber) can be used.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
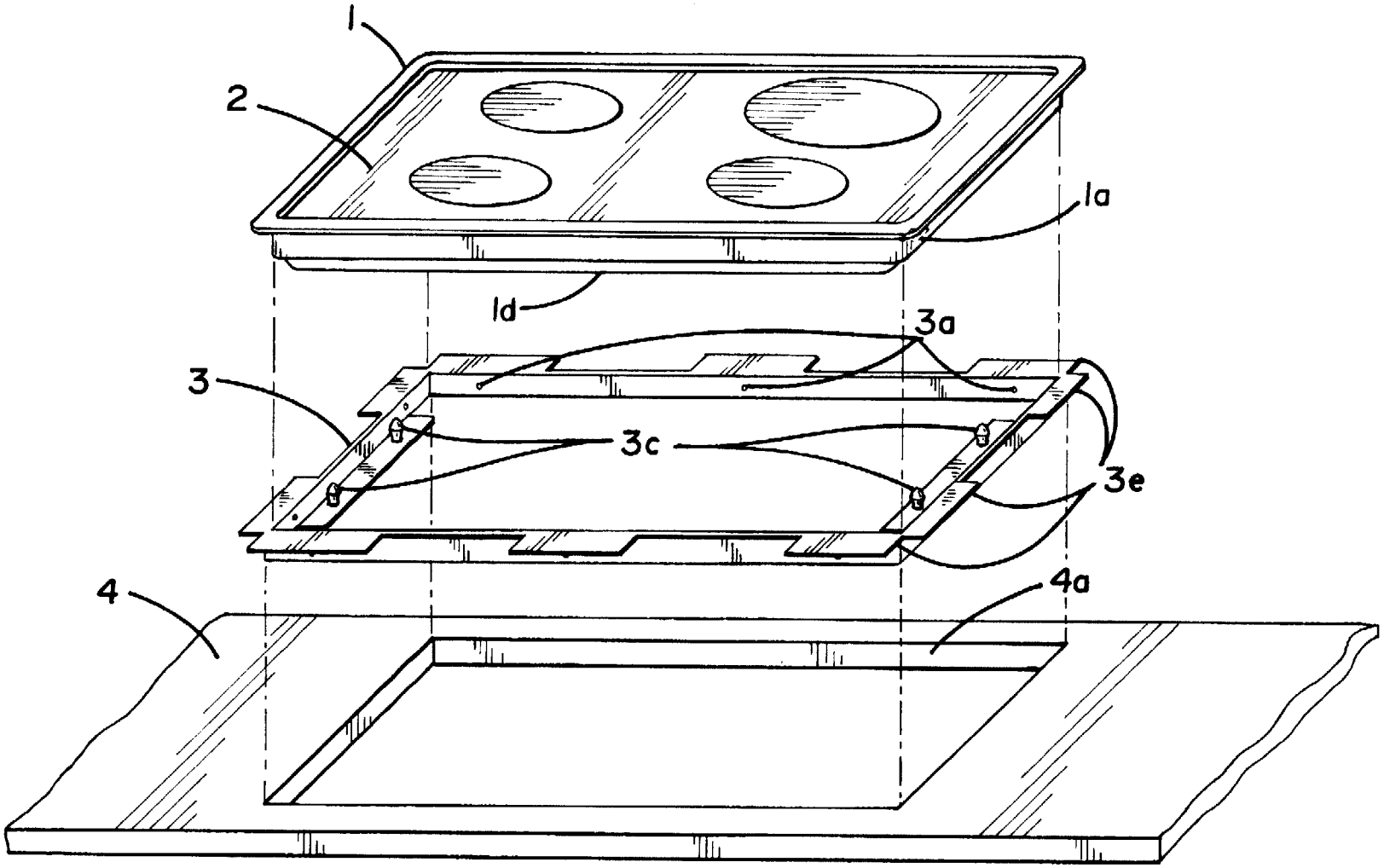
FIG. 1 is a schematic perspective view of the assembly sequence for an arrangement according to the invention.

The sequence provided by the invention of the assembly of a built-in cooktop 1 into the cutout 4*a* of a kitchen countertop 4 is shown schematically in FIG. 1.

The ancillary assembly frame 3 has the bores 3*a* for fixing in the cutout 4*a* of the countertop 4. After the ancillary assembly frame 3 is seated in the cutout 4*a* of the countertop 4, the ancillary assembly frame is fixed with suitable attachment elements, for example, screws 3*b* (see FIG.2) on its edge. Upwardly directed conical pins 3*c* function to receive the built-in cooktop 1. The cooktop 1 is then seated in the ancillary assembly frame 3. The conical pins 3*c* engage in corresponding catch openings 1*a* in the cooktop housing 1*d*.

Figure 2:
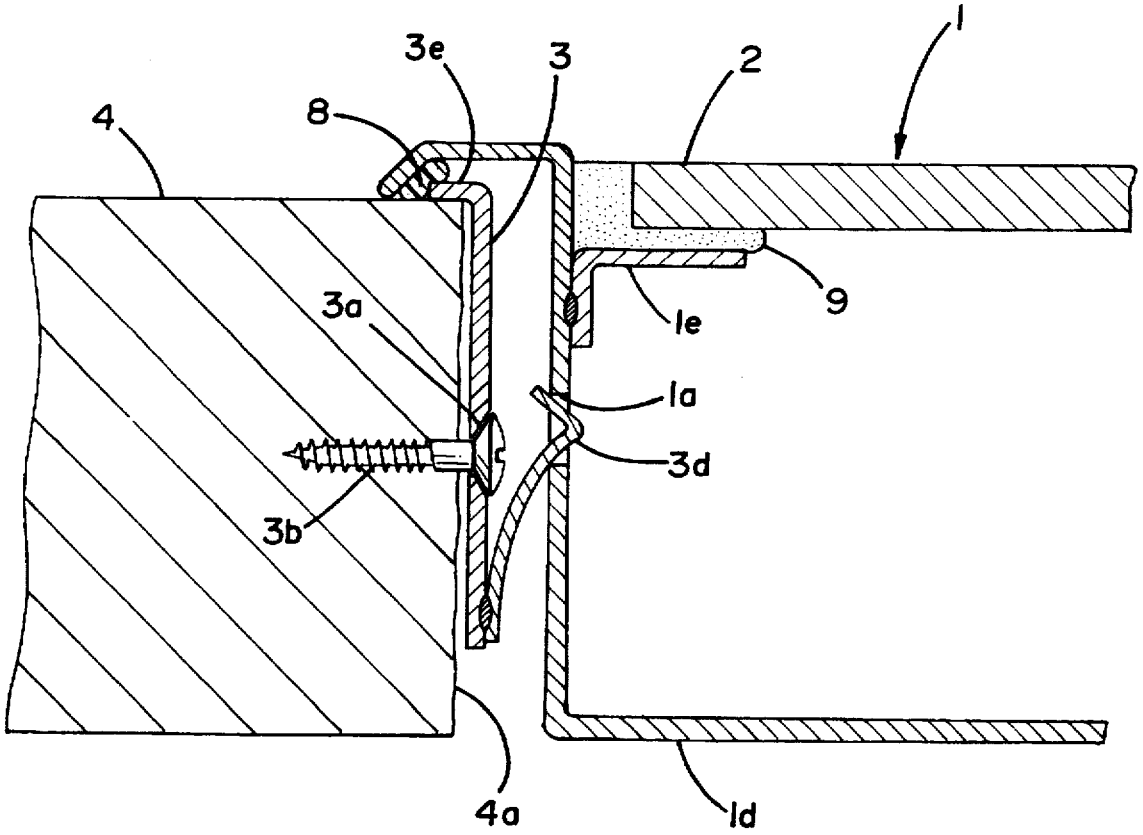
FIG. 2 is a schematic lateral view of a built-in cooktop mounted in accordance with the invention.

FIG. 2 is a vertical section view and schematically shows a cooktop 1 already mounted from above. In this case, the cooktop 1 has a cook plate 2 mounted with adhesive and the cooktop is held by means of resilient metal prongs 3*d* mounted laterally around the periphery in the ancillary assembly frame 3. The resilient metal prongs 3*d* project into corresponding latch openings 1*a* in the cooktop housing 1*d*. The ancillary assembly frame 3 was previously inserted from above into the countertop cutout 4*a* and is fixed, for example, by means of screws 3*b*. The cook plate 2 lies on the support frame 1*e* and is fixed by means of adhesive 9. The support frame 1*e* is attached to the cooktop housing 1*d*. The seal with respect to the countertop 4 is defined by a sealing bead 8 made, for example, of polyurethane.

Figure 3:
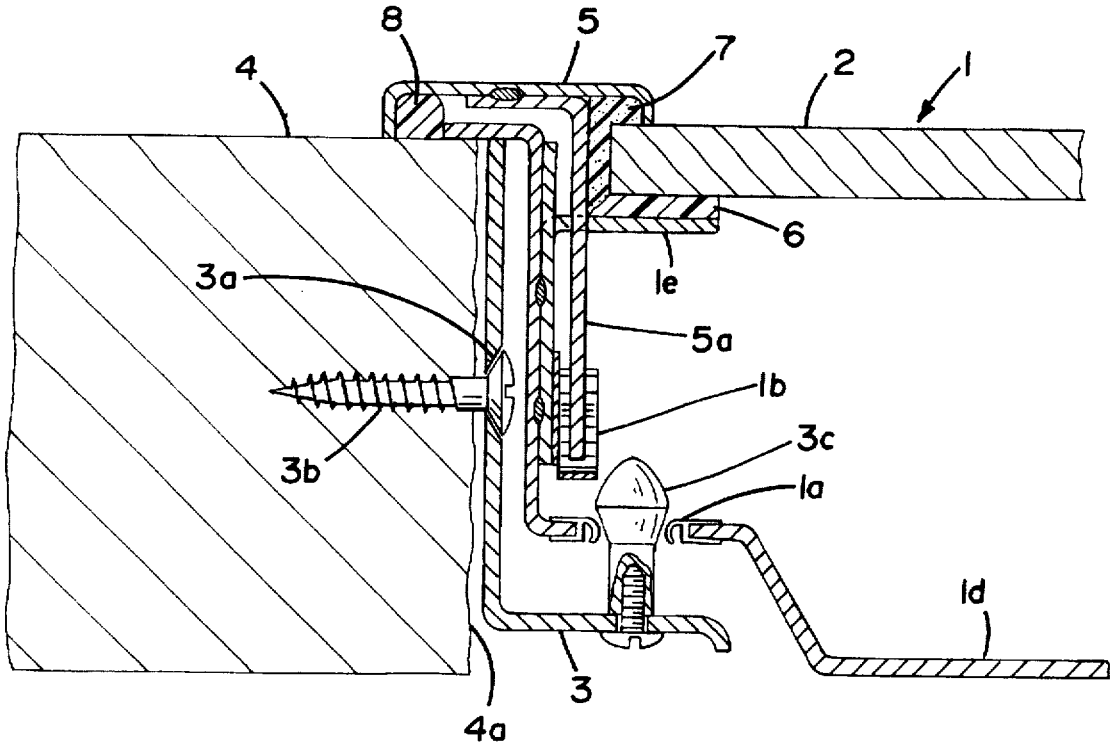
FIG. 3 is a schematic side elevation view of a preferred embodiment of a built-in cooktop mounted in accordance with the invention.

FIG. 3 is similar to FIG. 2 and shows an embodiment wherein the cook plate 2 is clamped between a decorative frame 5 and a support frame 1*e*. The decorative frame 5 is inserted from above and the support frame 1*e* is attached to the cooktop housing 1*d*.

The cook plate 2 is placed on a permanent-elastic seal support 6 on the support frame 1*e*. Latch prongs 5*a* are bent over downwardly and latch in corresponding flat resilient elements 1*b* on the cooktop housing 1*d*. The spring force causes the cook plate 2 to be held reliably and so that it can be used for the intended purpose. A seal profile 7 made of a soft foamed material provides for an adequate seal between the cook plate 2 and the decorative frame 5. The seal profile 7 is made of a soft foam material because of the temperature requirements and is preferably of silicone foam. The sealing toward the countertop 4 is provided, as in FIG. 2, by a polyurethane sealing bead 8.

The cooktop here essentially comprises a cooktop housing 1*d* having a support frame 1*e* and a decorative frame 5 as well as a cook plate 2. The cooktop 1 is, in this case, held in the ancillary assembly frame 3 by means of conical pins 3*c* projecting upwardly into the base of the cooktop 1.

FIG. 4 shows an embodiment again schematically in a perspective view (here without cook plate).

Figure 4:
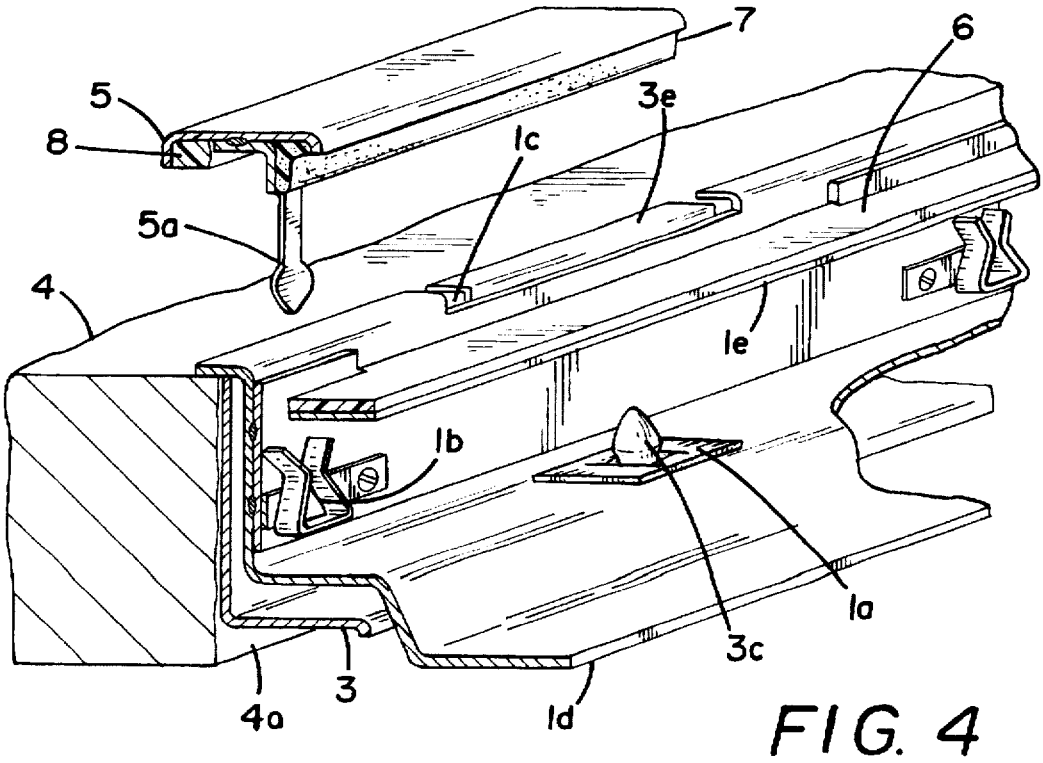
FIG. 4 is a schematic perspective view of the arrangement of FIG. 3; and, FIG. 5 is a schematic side view of a further preferred embodiment of a built-in cooktop mounted in accordance with the invention.

As can be seen in FIG. 4, the cooktop housing 1*d* has cutouts 1*c* in the upper bent-over portion which provides for a planar positioning on the countertop 4. The support legs 3*e* of the ancillary assembly frame 3 projects into the cutouts 1*c*. The support legs 3*e* lie on the countertop 4.

In the preferred embodiment of the invention shown in FIGS. 3 and 4, the cook plate can be attached via a adhesive connection to the support frame 1*e* as shown in FIG. 2.

Figure 5:
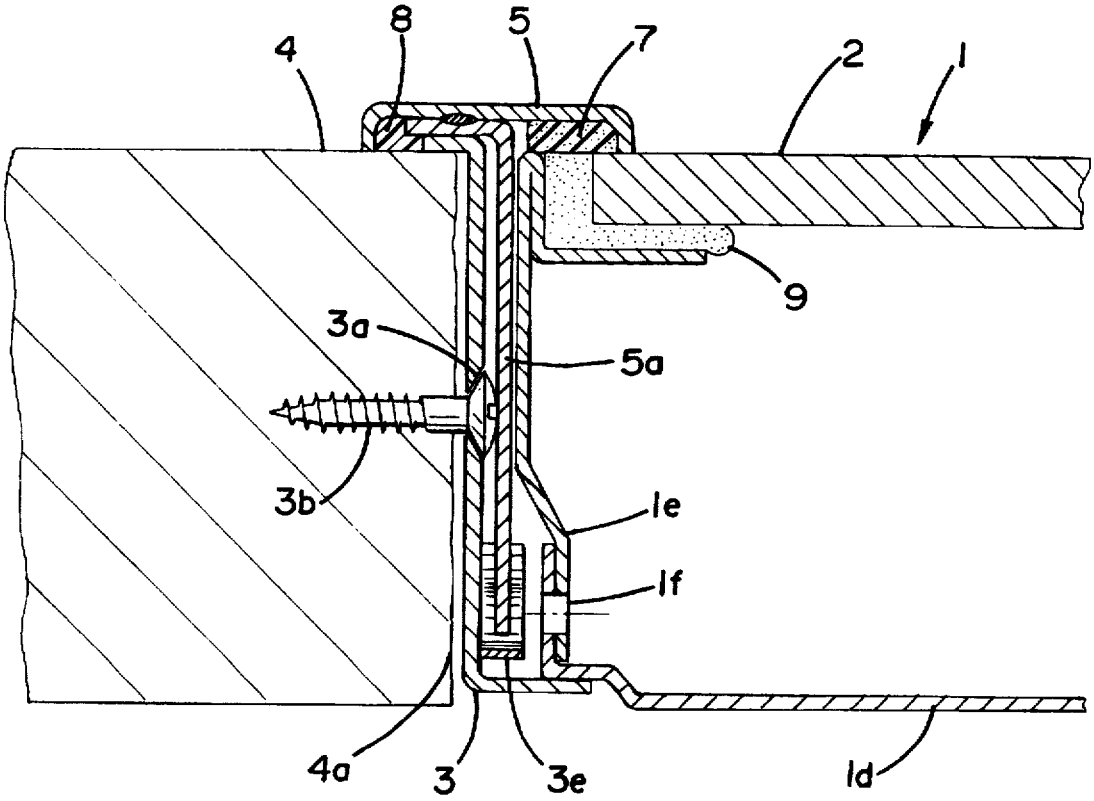

FIG. 5 shows a further cooktop construction which is convenient to assemble. Here, the cooktop 1 has the cook plate 2 mounted with adhesive 9 and the cooktop 1 lies on the legs of the ancillary assembly frame 3 which are bent over horizontally. In this case, the cooktop is fixed mechanically by the decorative frame 5 having latch prongs 5*a* bent over downwardly. These latch prongs 5*a* are similar to the latch prongs shown in FIGS. 3 and 4 and engage into corresponding laterally mounted spring elements 3*e* in the ancillary assembly frame 3. The spring elements correspond to those spring elements 1*b* already shown in FIGS. 3 and 4.

The cooktop housing 1*d* includes support frame 1*e* and cook plate 2. In this embodiment, the cooktop housing 1*d* lies on a corresponding support surface on the ancillary assembly frame 3. This support surface can, for example, be bent over support legs. The clamping connection or latch connection to the ancillary assembly frame 3 is produced exclusively by the inserted decorative frame 5.

The sealing to the countertop 4 and to the cook plate 2 is provided by means of the seals 8 and 7 already shown in FIG. 3. The cooktop 1 is configured as two parts in FIG. 5. The support frame 1*e* supports the cook plate 2 and is releasibly connected to the cooktop housing 1*d*, for example, by means of screws, clamp bolts or the like. The heating elements (not shown) are mounted in the cooktop housing 1*d*. The cooktop 1 has corresponding lateral bulges in the region of the flat spring elements 3*e*.

It is advantageous in this embodiment that, in this essentially 3-part construction (cooktop 1, ancillary assembly frame 3 and decorative frame 5), the ancillary assembly frame 3, the cooktop housing 1*d* as well as the support frame 1*e* can be standardized. Only the decorative frame 5 is adapted with its surface to the entire design in correspondence to the particular design desired. The decorative frame 5 can, for example, comprise anodized aluminum, high-grade steel or color-coated steel sheet metal.

We claim:

1. A cooktop arrangement mountable into a cutout of a countertop from above the countertop, the arrangement comprising:

a cooktop;

an ancillary assembly frame adapted to accurately fit to said cooktop;

means for fixing said ancillary assembly frame in the cutout;

said cooktop being seated in said ancillary assembly frame and conjointly defining an interface therewith;

a plurality of latching devices at said interface for releasably holding said cooktop in said ancillary assembly frame thereby permitting the easy manual removal of said cooktop from said ancillary assembly frame;

said cooktop including: a housing; and, said housing and said ancillary assembly frame conjointly defining said interface;

said cocktop further including a support frame mounted in said housing; a cook plate seated on said support frame; a decorative frame engaging over said cook plate; and, a plurality of first connecting elements mounted on said decorative frame and a second plurality of connecting elements mounted on said housing for engaging corresponding ones of said first connecting elements to hold said decorative frame in said housing when said decorative frame is inserted from above into said housing.

2. The arrangement of claim 1, said first and second connecting elements conjointly developing a first resilient biasing force for holding said decorative frame in said housing; and, said latching devices at said interface being configured to hold said housing in said ancillary assembly frame with a second resilient biasing force smaller than said first resilient biasing force.

3. The arrangement of claim 1, said cook plate being clamped between said decorative frame and said support frame; said cooktop further including a sealing profile interposed between said decorative frame and said cook plate as well as between said support frame and said cook plate.

4. The arrangement of claim 1, said cooktop further comprising means for detachably connecting said support frame and said housing to each other.

5. A cooktop arrangement mountable into a cutout of a countertop from above the countertop, the arrangement comprising:

a cooktop;

an ancillary assembly frame adapted to accurately fit to said cooktop;

means for fixing said ancillary assembly frame in the cutout;

said cooktop being seated in said ancillary assembly frame and conjointly defining an interface therewith;

a plurality of latching devices at said interface for releasably holding said cooktop in said ancillary assembly frame thereby permitting the easy manual removal of said cooktop from said ancillary assembly frame;

said cooktop including: a housing; said housing and said ancillary assembly frame conjointly defining said interface; said cooktop further including a support frame mounted in said housing; a cook plate seated on said support frame; and, a decorative frame engaging over said cook plate; and, each of said latching devices including a first connecting element mounted on said decorative frame and a second connecting element mounted on said ancillary assembly frame to releasably engage said first connecting element when said decorative frame is inserted into said ancillary assembly frame from above said countertop.

6. The arrangement of claim 5, said cook plate being clamped between said decorative frame and said support frame; said cooktop further including a sealing profile interposed between said decorative frame and said cook plate as well as between said support frame and said cook plate.

7. The arrangement of claim 5, said cooktop further comprising means for detachably connecting said support frame and said housing to each other.

* * * * *